US006449961B1

(12) United States Patent
Korsgaard

(10) Patent No.: US 6,449,961 B1
(45) Date of Patent: Sep. 17, 2002

(54) METHOD FOR TRANSPORTATION OF LOW MOLECULAR WEIGHT HYDROCARBONS

(76) Inventor: Jens Korsgaard, 318 N. Post Rd., Princeton Junction, NJ (US) 08550

( * ) Notice: Subject to any disclaimer, the term of this patent is extended or adjusted under 35 U.S.C. 154(b) by 0 days.

(21) Appl. No.: 09/763,003

(22) PCT Filed: Aug. 11, 1999

(86) PCT No.: PCT/US99/18208

§ 371 (c)(1),
(2), (4) Date: Feb. 12, 2001

(87) PCT Pub. No.: WO00/09851

PCT Pub. Date: Feb. 24, 2000

Related U.S. Application Data

(60) Provisional application No. 60/096,019, filed on Aug. 11, 1998, and provisional application No. 60/131,722, filed on Apr. 30, 1999.

(51) Int. Cl.[7] ..... F17C 11/00
(52) U.S. Cl. ..... 62/46.1; 62/240
(58) Field of Search ..... 62/46.1, 240

(56) References Cited

U.S. PATENT DOCUMENTS

| | | | |
|---|---|---|---|
| 1,638,434 | A | 8/1927 | Curme, Jr. et al. |
| 1,912,044 | A | 5/1933 | Schmidt |
| 2,938,359 | A | 5/1960 | Cobb, Jr. et al. |
| 5,199,266 | A | 4/1993 | Johansen |

FOREIGN PATENT DOCUMENTS

| | | |
|---|---|---|
| CA | 2205678 | 5/1998 |
| WO | WO 98/14362 | 4/1998 |

*Primary Examiner*—Ronald Capossela
(74) *Attorney, Agent, or Firm*—Kenyon & Kenyon

(57) ABSTRACT

A system achieving a high density of transported natural gas by compressing it to high pressures typically above 5 MPa to transport the gas in a modified composition that permits a very low compressibility factor at near ambient temperature either above or below. This reduces greatly the size of the cooling systems that are required. In some cases cooling of the compressed gas may be achieved in a simple heat exchanger cooled by air or water. The transport of the gas takes place in self propelled ships or non-self propelled barges fitted with a cargo containment system capable of storing the cargo at high pressures, typically above 5 MPa and usually not above 25 MPa. The transport vessel may carry a store of higher molecular weight gases (c2 through c7) that when mixed with the incoming cargo results in a molecular weight of the mixture of at least 22 and possibly as high as 28 or higher. The store of higher molecular weight cargo may be gained from gases that condense during discharge of the vessel at its destination due to the adiabatic cooling of the cargo during discharge. These liquids may be retained aboard and transported back to the origin. If insufficient quantities of heavy gases are available at the origin they may be loaded at the destination. If required, the composition of the heavy gases transported back to the origin may be changed through partial discharge or partial receipt of additional hydrocarbons or a combination thereof at the destination point.

15 Claims, 6 Drawing Sheets

METHOD FOR TRANSPORTATION OF LOW MOLECULAR WEIGHT HYDROCARBONS

This application claims the benefit of U.S. provisional application No. 60/096,019, filed Aug. 11, 1998 and No. 60/131,722, filed Apr. 30, 1999.

BACKGROUND OF THE INVENTION

1. Field of the Invention

The present invention relates generally to the transport of low molecular weight hydrocarbons under high pressure by ship or barge.

2. Background Art

A number of concepts have been advanced in recent years to produce and transport lighter hydrocarbons (c1 through c7) offshore in a form that is relatively dense such that it becomes suitable for transportation by ship. This may be achieved by cooling the gas and compressing the gas to a modestly high pressure of 1 to 2 MPa (U.S. Pat. No. 5,199,266) or it may be achieved by compressing the gas to a high pressure in special containers (PCT WO 98/14362). The latter system also benefits from using a low temperature during the transport.

SUMMARY OF THE INVENTION

An object of the present invention is to achieve a high density of transported natural gas by compressing it to high pressures typically above 5 MPa to transport the gas in a modified composition that permits a very low compressibility factor at near ambient temperature either above or below. This reduces greatly the size of the cooling systems that are required with the present technologies. In some cases cooling of the compressed gas may be achieved in a simple heat exchanger cooled by air or water.

The invention is based on the observation that an ideal gas that is transported under pressure requires a constant ratio between the weight of the containing pressure vessel and the gas regardless of pressure when the strength of the pressure vessel materials and the gas temperature remain constant. However, hydrocarbon gas mixtures are not ideal gases and may deviate from the ideal by a so-called compressibility factor z that in certain circumstances may attain a value of z=0.33 or lower. Thus in the example of z=0.33 the ratio of gas weight to container weight is 3 times that of the corresponding ideal gas. When mixing another gas into the gas being transported the number of molecules to be transported increases, however the value of compressibility factor z may decrease. The increase in total number of molecules by adding the mixing gas reduces the quantity of transport gas that can be carried and the reduction in z increases the quantity of transport gas (and of mixing gas) that can be carried. Later in this specification is shown an example in which that the quantity of transport gas that can be carried at a given temperature and pressure increases more than 50% compared to case in which no mixing gas is mixed into the transport gas.

The condition of transport, i.e. pressure and temperature may be such that the mixture is carried at a temperature below the critical temperature, but above the critical pressure in which case the mixture is transported in the so called dense phase.

The transport of the gas takes place in self propelled ships or non-self propelled barges fitted with a cargo containment system capable of storing the cargo at high pressures, typically above 5 MPa and usually not above 25 MPa.

Offshore such vessels are normally loaded at a single point mooring or a multi-buoy mooring connected by subsea pipeline to a process platform. Similar systems are often used when the vessel is loaded from or discharges to facilities on land. The vessels may also be loaded and/or discharged at ordinary fixed berths.

The invention is also applicable to transport of natural gas under high pressure in railroad cars and trucks.

When the mixture of gasses has a molecular weight below about 20 it may not be possible to achieve dense phase at ambient temperatures in the range of 0 to 40 deg C. The transport vessel in consequence may carry a store of higher molecular weight gases (c2 through c7) that when mixed with the incoming cargo results in a molecular weight of the mixture of at least 22 and possibly as high as 28 or higher. The store of higher molecular weight cargo may be gained from gases that condense during discharge of the vessel at its destination due to the adiabatic cooling of the cargo during discharge. These liquids may be retained aboard and transported back to the origin. If insufficient quantities of heavy gases are available at the origin they may be loaded at the destination. If required, the composition of the heavy gases transported back to the origin may be changed through partial discharge or partial receipt of additional hydrocarbons or a combination thereof at the destination point.

The natural gas to be transported is sometimes available at pressures as low as 2 MPa or even lower. Compression of the gas is therefore required prior to being loaded aboard the transport ship. The heat of compression causes significant increases in temperature of the gas. In order to increase the density of the transported gas it may be cooled. The required cooling of the compressed gas may partly or fully take place through exchange of heat through the wall of a submarine pipeline between the compressor and the loading facility. Through this process the gas may reach a temperature that is slightly above the seawater temperature at the seabed before reaching the ship. In the event that no submarine pipes are used the compressed gases may be cooled in an air-cooled heat exchanger and subsequent adiabatic expansion into the storage vessel may result in a final temperature near ambient when the transport pressure is reached. Low temperatures in the storage vessel result in a higher density of the gas being transported. However, it may be advantageous for reasons of safety to maintain a transport temperature slightly above ambient in order to prevent actuation of safety relief valves in accident conditions where the lowered temperature cannot be maintained.

This invention teaches the mixing of a mixing gas into the gas to be transported (transport gas) when it is loaded onto the transport vehicle. The mixing gas is comprised of hydrocarbons and typically has a higher molecular weight than the transport gas.

All heavier hydrocarbons in the mixing gas can be recovered at the destination through known technologies and re-loaded aboard the transport vessel for transport back to the origin. Thus even pure methane can be transported at higher transport densities at near ambient temperatures by being mixed with heavier hydrocarbons at the origin that are recovered from the mixture at the destination.

BRIEF DESCRIPTIONS OF THE DRAWINGS

DETAILED DESCRIPTIONS OF THE PREFERRED EMBODIMENTS.

The present invention is partly based-on the observation that mixtures of hydrocarbons in the range of c1 through c7 may be compressed into a so called dense phase where the mixture exhibit properties closer to that of a liquid rather than a gas. Specific reference is made to "ULTRA-HIGH PRESSURE ARCTIC NATURAL GAS PIPELINES" by Graeme King, given at the Fifth Annual Pipeline Conference of the Pipeline Division of the Canadian Petroleum Association, Calgary Alberta, May 14 through 16, 1991.

The referenced paper lists 5 hydrocarbon mixtures as exhibited in table 1.

Figure 1:
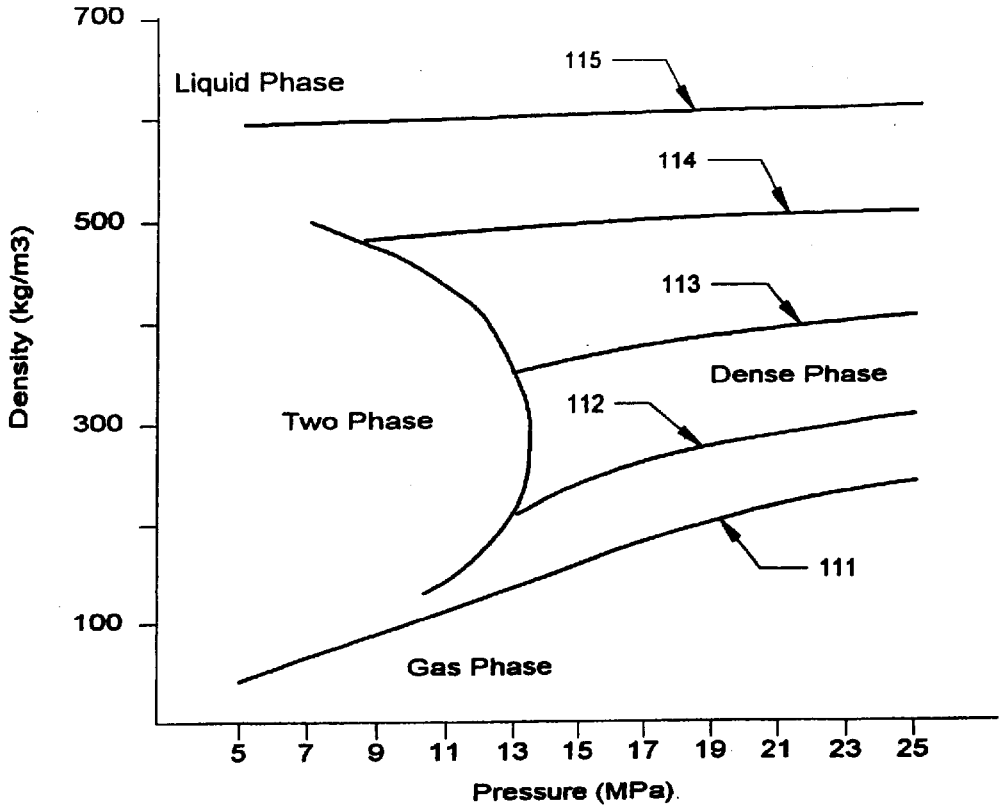
FIG. 1 shows a phase diagram at 0 deg C. for typical hydrocarbon mixtures that may be stored or transported.

The intermediate mixtures 2,3, and 4 are mixtures in the stated proportions of mixtures 1 and 5. A phase diagram at 0 deg C. is shown in FIG. 1 for each of the mixtures 1 through 5. The density versus pressure is diagramed for each of the mixtures, denoting the curve for mixture 1 111; the curve for mixture 2 112; 113 for mixture 3; 114 for mixture 4; and 115 for mixture 5. It is noted that mixture 1 at the temperature of 0 deg C. behaves like a real gas at all pressures shown and that mixture 5 largely behaves like a liquid for all pressures above 4 MPa. The intermediate mixtures 2, 3, and 4 are in two phases (a mixture of liquids and gasses) at low pressures and in dense phase at higher pressures. Taking the example of mixture 2, 112 on FIG. 1, this mixture is in dense phase above a pressure of 13 MPa and splits into two phases below the pressure of 13 MPa.

The amount of methane that a storage container may contain at for example 0 deg C. increases as it is mixed with heavier hydrocarbons at for example a pressure of 14 MPa, absolute. Pure methane at the stated condition has a density of 104 kg/m$^3$. Thus one m$^3$ of storage contains 104 kg of methane. Mixture 2 has a density of 190 kg/m$^3$. Mixture 2 has a molecular weight of 21.87. In consequence one m$^3$ of mixture 2 at 0 deg C. and 14 MPa absolute pressure contains 118 kg/m$^3$ of methane when in dense phase at the stated conditions. Thus by mixing heavier hydrocarbons (c2 through c7) into a low molecular weight gas the amount of methane that can be stored or transported may increase.

The highest temperature at which dense phase may be achieved is approximately 0 deg C. for mixture 2 and 40 deg C. for mixture 3. Since ambient temperatures in the various climatic zones on earth typically range from about 0 to 40 deg C. it is possible to transport lighter mixtures of hydrocarbons having a molecular weight in the range of 16 to 22 in dense phase at ambient temperatures by mixing them with heavier hydrocarbons (c2 through c7) to achieve molecular weights in the range of 22 to 27 or even higher.

It is noted that associated gas that is produced at oil wells frequently are similar to mixtures 2 or 3 in composition and as such may possibly be transported in dense phase under high pressures typically in excess of 10 MPa but in some cases as high as 14 MPa or possibly somewhat higher depending on the specific mixture. The mixtures shown in FIG. 1 and table 1 are only examples of possible mixtures. There is an infinite number of possible combinations of light hydrocarbon gases. Their exact phase behavior can only be approximately predicted by theoretical formulae, thus laboratory tests may be required to assess he behavior of practical mixes given the composition of gases to be received upstream. This invention makes it possible in all cases to obtain the optimal mixture to maximize the quantity of upstream gas that can stored in a given container (and thereby transported) at a given (near ambient) temperature and at a given pressure (that permits the formation of dense phase). This is achieved by mixing into the incoming gas stream at the upstream point a stream of heavier gases such that the desired mixture is achieved.

At the downstream delivery point the gas is expelled from the container by a reduction of pressure all the way down to the downstream delivery pressure This pressure may be a low as 1 MPa or even lower. In consequence the mixture that is delivered reduces its temperature due to adiabatic expansion and reduces its pressure due to the withdrawal of gas from the container. Thus the mixture in the container goes from being in dense phase to being in two phases with gas comprised primarily of low molecular weight gases at the top of the container and higher molecular weight gases in liquid form at the bottom of the container.

In its simplest form of the application of this invention the liquids are retained in the containers aboard the vessel and returned to the upstream delivery point. There they are mixed into the incoming gases by bubbling the incoming gases through the liquid thereby mixing them. When the proper temperature and pressure for dense phase is achieved the mixture will go into dense phase. After a few voyages the amount retained aboard as a liquid may become constant and the gas delivered downstream then has the same composition as the gas received upstream.

Above is stated a particular case of transporting gas in dense phase. However, increases in partial density of the transport gas may also be achieved in the two phase region as follows:

An ideal gas obeys the ideal gas law:

$$P*V=N*R*T$$

Where:

P is the absolute pressure

V is the volume

N is the number of moles of the gas

R is the universal gas constant

T is the absolute temperature

However hydrocarbons in the range c1 through c7 are not ideal gases and in particular mixtures of hydrocarbons in the range c1 through c7 often exhibit behavior far removed from the ideal gas law. In order to reasonably describe the behavior of such mixtures it is customary to modify the ideal gas law as follows:

$$P*V=Z*N*R*T$$

Where:

Z is the so-called compressibility factor

Z may assume values from above 1.0 to as low as 0.33 or even lower. Values above 1.0 cause that the container can contain less gas than if the gas obeys the ideal gas law. Conversely for low values of Z such as for example 0.33 the container may hold 3 times the number of moles of gas compared to a gas obeying the ideal gas law.

When adding another, usually higher molecular weight, gas mixture to a given gas to be transported the total number of moles to be transported increases. However, if the Z factor reduces proportionally more than the increase in the total number of moles, then the quantity of the transport gas that can be transported increases as well. A specific example of this is given in FIG. 2. The composition of the transport gas is given as an example in table 2. The composition of the mixing gas is given in table 3.

Figure 2:
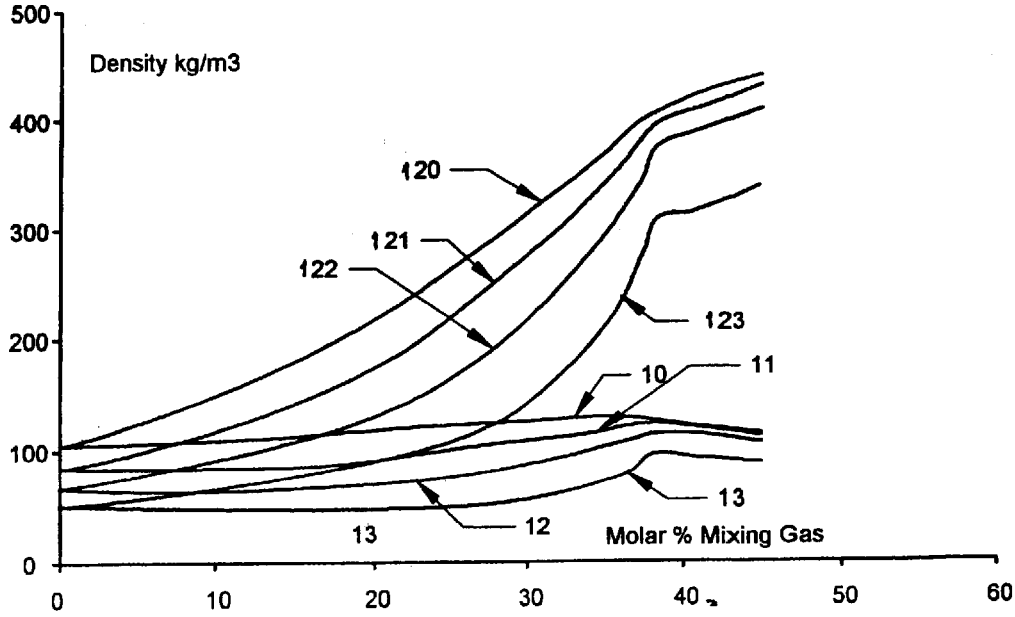
FIG. 2 shows the transport density of the transport gas for a range of possible mixtures in which a mixture of c3 through c6 is the mixing gas and a low molecular weight natural gas is the transport gas.

FIG. 2 shows the partial density of transport gas in the container and the density of the mixture, i.e. the sum of the partial densities of the transport gas and of the mixing gas in the container. Curves for 4 different pressure are shown. These calculations are based on empirical data given in tabular form in "Practical Natural Gas Engineering, Second Edition" by R. V. Smith, Pennwell Books Tulsa Okla., 1990.

The curve 10 shows the partial density of the transport gas at 40 deg C. and an absolute pressure of 13.9 MPa. Curve 120 shows the density of the mixture at the absolute pressure 13.9 MPa and 40 deg C. The transport gas shows a maximum partial density at a mixture of 63 mol % transport gas and 37 mol %. mixing gas. For the conditions stated above 20% more transport gas can be carried in the same container by adding the mixing gas until the above-described mixture is attained. Curves 11 and 121; 12 and 122; and 13 and 123 show the density of the transport gas (11, 12, and 13) and the mixture (121, 122, and 123) at pressures of 11.1, 9.1, and 7.0 MPa respectively and a temperature of 40 deg C. In all cases a maximum density is obtained for an approximate mixture of 60–65 mol % transport gas and 40–35 mol %. mixing gas. The increase in the amount of transport gas that can be carried is 48%, 78%, and 96% respectively when compared to the carriage of pure transport gas at the same pressures and temperatures.

At the downstream delivery point the gas may expel from the container by a reduction of pressure all the way down to the downstream delivery pressure. This pressure may be a low as 1 MPa or even lower. Alternatively the gas may be withdrawn from the container by a compressor taking suction at the container. In consequence the mixture that is delivered reduces its temperature due to adiabatic expansion and reduces its pressure due to the withdrawal of gas from the container. Typically in this process some of the heavier hydrocarbons drop out of the mixture forming a two-phase system with a liquid in the bottom of the container with a relatively high molecular weight and a gas phase in the top with a relatively low molecular weight.

In its simplest form of the application of this invention the liquids are retained in the containers aboard the vessel and returned to the upstream delivery point. There they are mixed into the incoming gases. This may be achieved by injecting the incoming gases into the liquid or may be done by injecting the liquids into the incoming gas stream. After a few voyages the amount retained aboard as a liquid may become constant and the gas delivered downstream then has the same composition as the gas received upstream.

Because the formulae, whether theoretical or empirical are recognized to be not very accurate near the critical point a further check of the concept was done by using the Peng-Robinson equation of State. See Peng, D. Y. and Robinson, D. B. "A New Two-Constant Equation of State," Ind. Eng.

Figure 3:
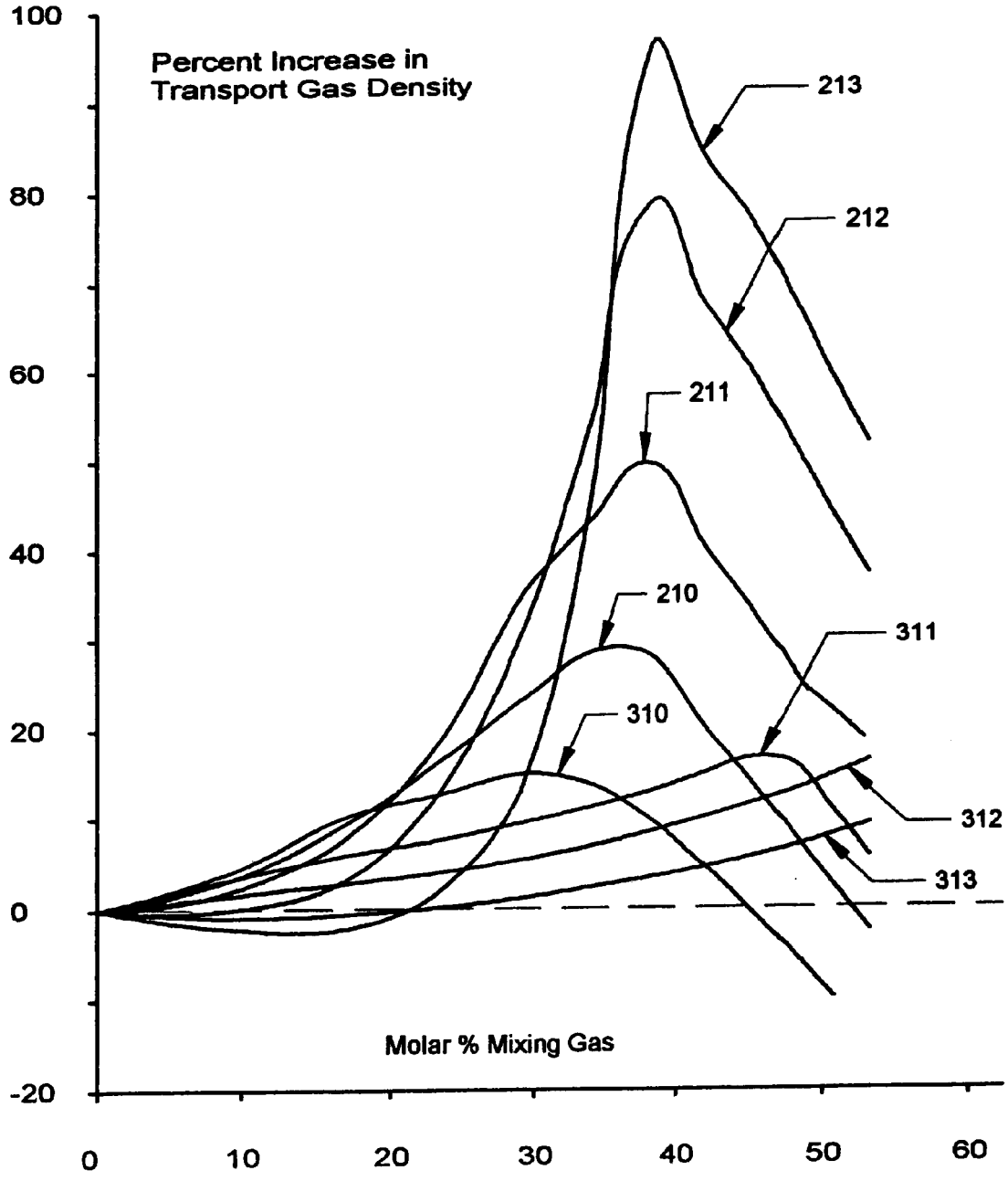
FIG. 3 Shows the diagram of FIG. 2 calculated by a different calculation method.

Chem. Fund., vol. 15, no. 1, pp. 59–64 (1976); "Design II" software, manufactured by WinSim. This was done for the example shown in FIG. 2. FIG. 3 shows the results of using the Peng-Robinson equations on the mixtures used in FIG. 2. Two sets of curves are shown in FIG. 3. The curves 210, 211, 212, 213 show the increase in transport density for the conditions denoted by the curves 10, 11, 12, and 13 in FIG. 2. The curves 310, 311, 312, and 313 show the increase in transport density using the Peng-Robinson equation of state. It is noted that the Peng-Robinson equation of state indicates up to 15% improvement in transport capacity compared to transporting pure gas at the same temperature and pressure. It is noteworthy that all methods indicate significant improvements in transport capacity when mixing a heavier gas into the transport gas, it is equally noteworthy that there are very large differences in the results from the two methods employed, thus pointing to the need of tests in each particular case.

Figure 4:
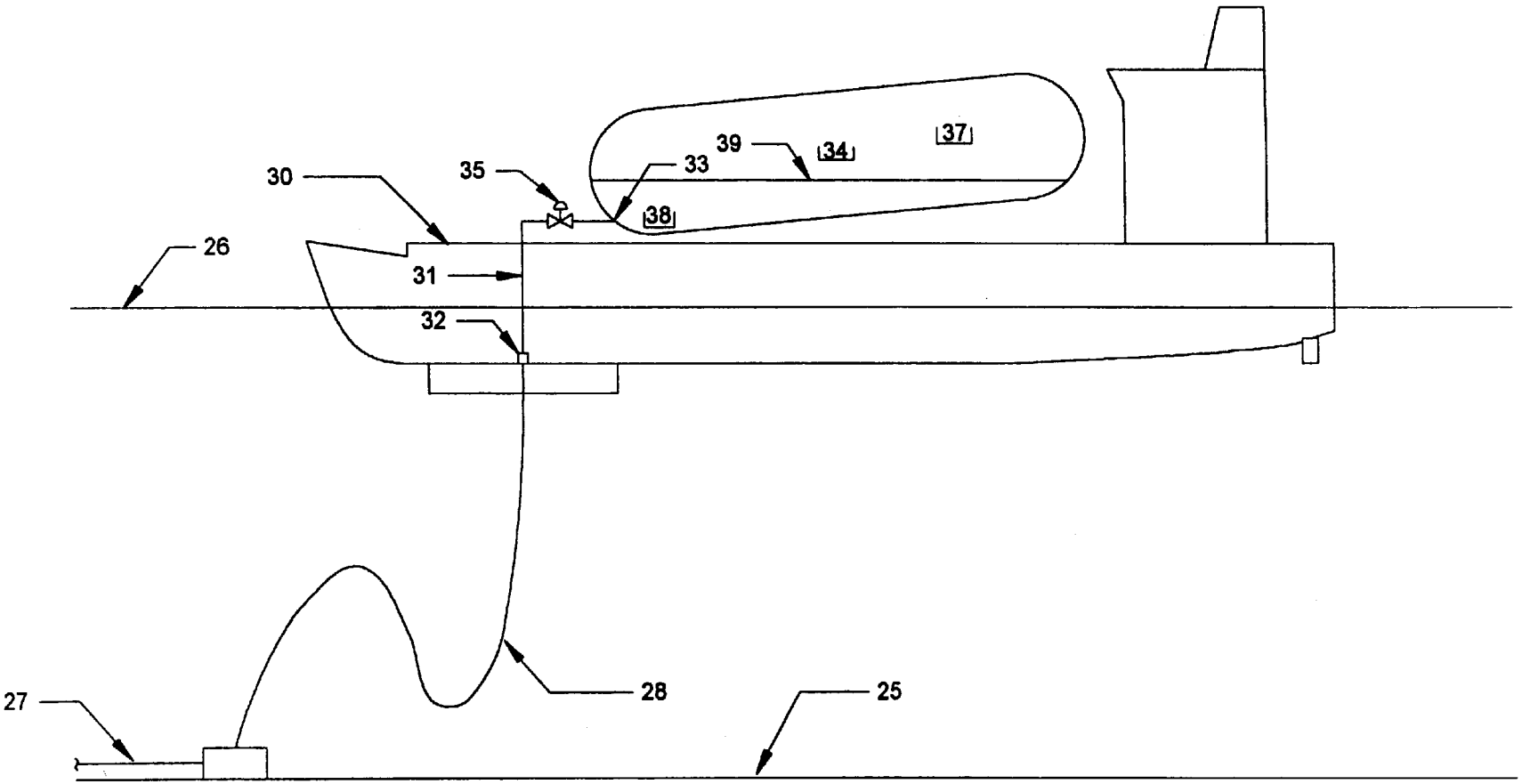
FIG. 4 Shows the loading of gas aboard a ship.
Figure 5:
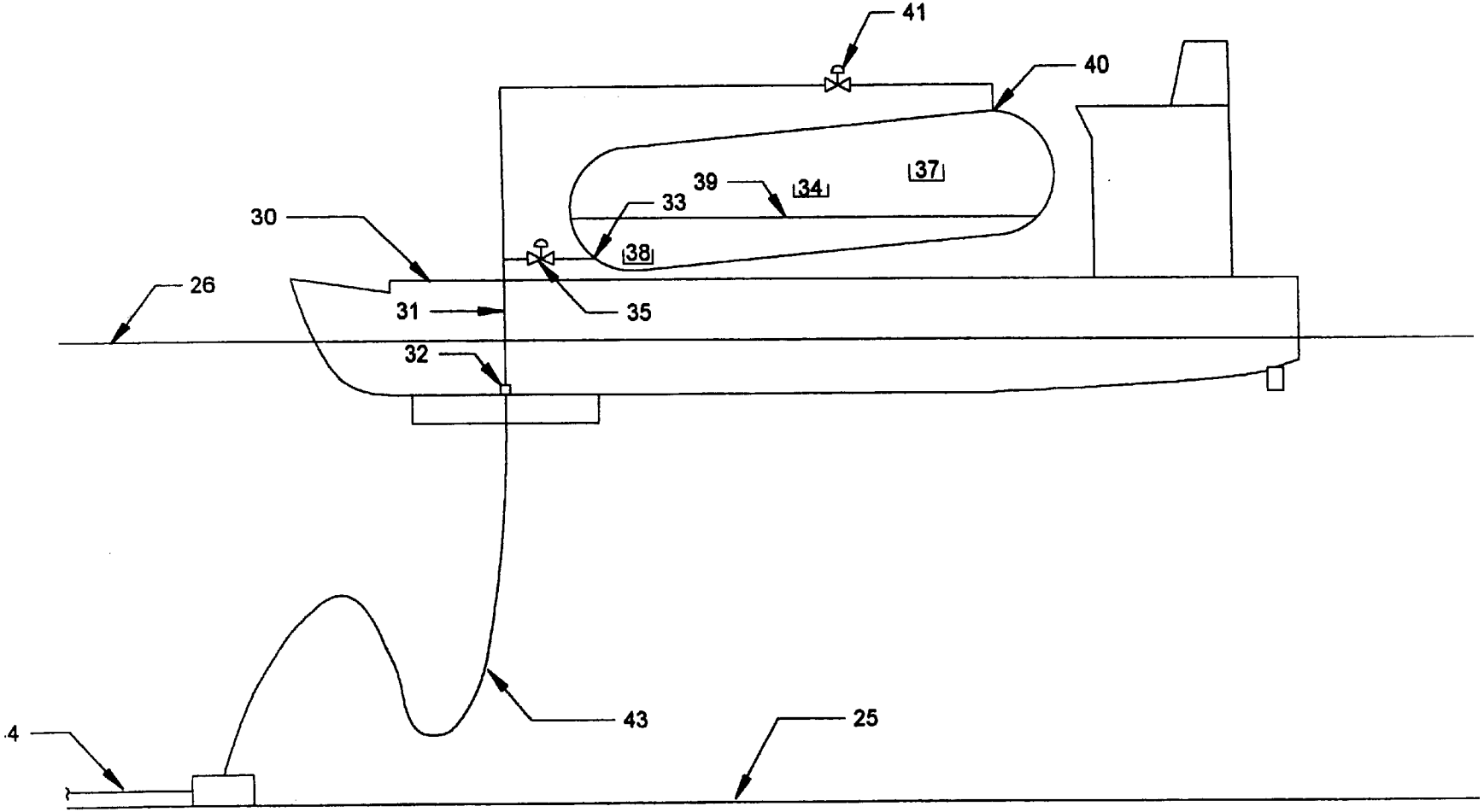
FIG. 5 Shows the discharge of gas from a ship at the destination

This first embodiment is illustrated in FIGS. 4 and 5.

FIG. 4 shows the transport ship 30 floating in the sea with surface 26 and seabed 25 at the receiving point for the gas cargo. The ship 30 may be moored by a number of known technologies, not shown. The vessel is connected to a source of compressed gas, not shown, through a submarine pipeline 27 that in turn connects to a riser 28 that is disconnectably connected to the piping 31 on vessel 30 at the connector 32. Piping 31 is connected to inlet 33 in the pressure storage tank 34 through valve 35. The pressure storage tank 34 is for clarity shown located on the deck of vessel 30, however, it would ordinarily be located within the hull of vessel 30. Pressure storage tank 34 would ordinarily be comprised of a large number of individual storage tanks 34, however, for clarity only one is shown.

The tank is shown receiving gas at an intermediate pressure below the design pressure such that the gas within the storage tank is in two phases, a gaseous phase occupying volume 37 and a liquid phase occupying volume 38 separated by the interface 39.

In this embodiment the transport gas is injected through inlet 33 into the liquids occupying volume 38. This process ensures both an efficient mixing of the transport gas and the liquids in volume 38 and also reduces the temperature excursions in tank 38, because the liquids in volume 38 act as a heat sink.

FIG. 5 shows gas being discharged at the destination. In this case the vessel 31 is also moored to a mooring system (not shown). The cargo is transferred through outlet 40 through the open valve 41 to connector 32. Connector 32 is connected to riser 43 connecting to pipeline 44 that in turn is connected to the receiving facility (not shown). The receiving facility (not shown) maintains a certain low back pressure such that the gas in tank 34 may discharge without the use of compressors. However, the vessel 30 may also be fitted with compressors (not shown) in order to deliver to receiving facilities (not shown) maintaining a relatively high back pressure.

During the pressure reduction in tank 34 liquids may drop out and collect in volume 38, separated from the gaseous volume 37 by interface 39. The valve 35 is ordinarily closed during the discharge of tank 34. However, valve 35 may be opened part of the time during discharge or may be used as a control valve that the optimal amount of liquid is retained in volume 38 for the return to the delivery point to be mixed into the incoming gas. This first embodiment is particularly effective in cases that the transport gas has a sufficiently high molecular weight that sufficient quantities of liquids drop out during discharge.

The liquid volume may then be transported back to the receiving point and serve as a mixing agent in order to achieve a mixture that can be transported at the optimal density.

FIGS. 4 and 5 show the vessel 30 with only one storage tank 34. However, normally the vessel 30 will be fitted with numerous storage tanks 34, however, only one is shown for clarity.

Figure 6:
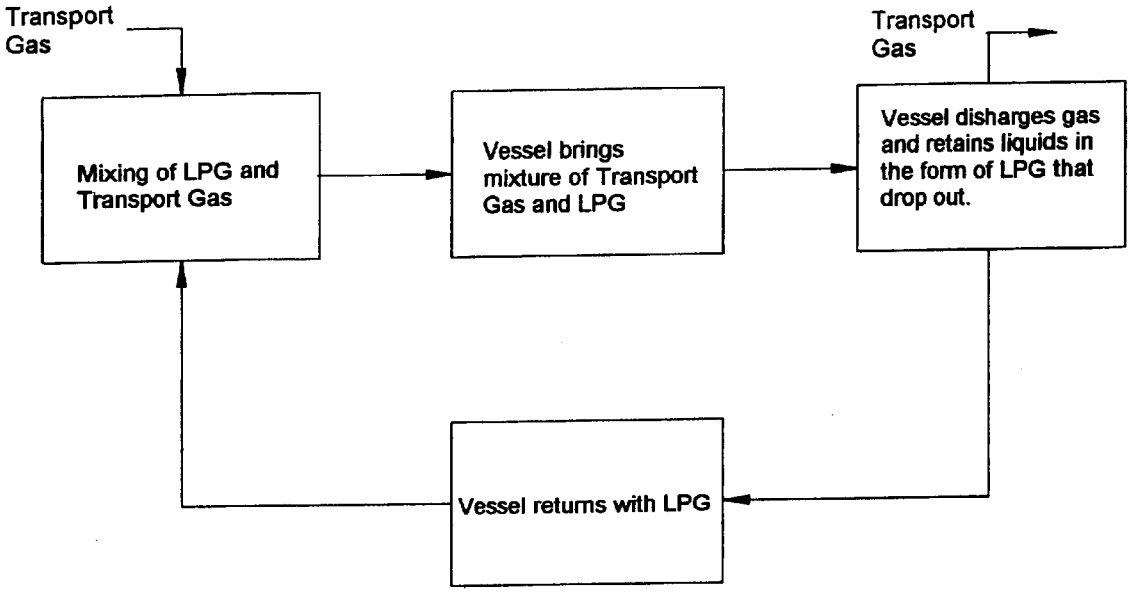
FIG. 6 is a diagram showing the shipping cycle as illustrated by FIGS. 4 and 5

FIG. 6 shows diagrammatically the transport cycle shown in FIGS. 4 and 5. The transport gas has in this case sufficient content of heavier gases that enough liquids drop out during discharge for use as mixing gas. Consequently only prior to the first voyage is an external supply of heavier hydrocarbons (mixing gas)required. The mixing gas would typically by liquid hydrocarbons consisting of mixtures rich in c3, c4, c5 and c6 and is also referred to herein and on FIGS. 7 and 8 as liquid petroleum gas (LPG).

Figure 7:
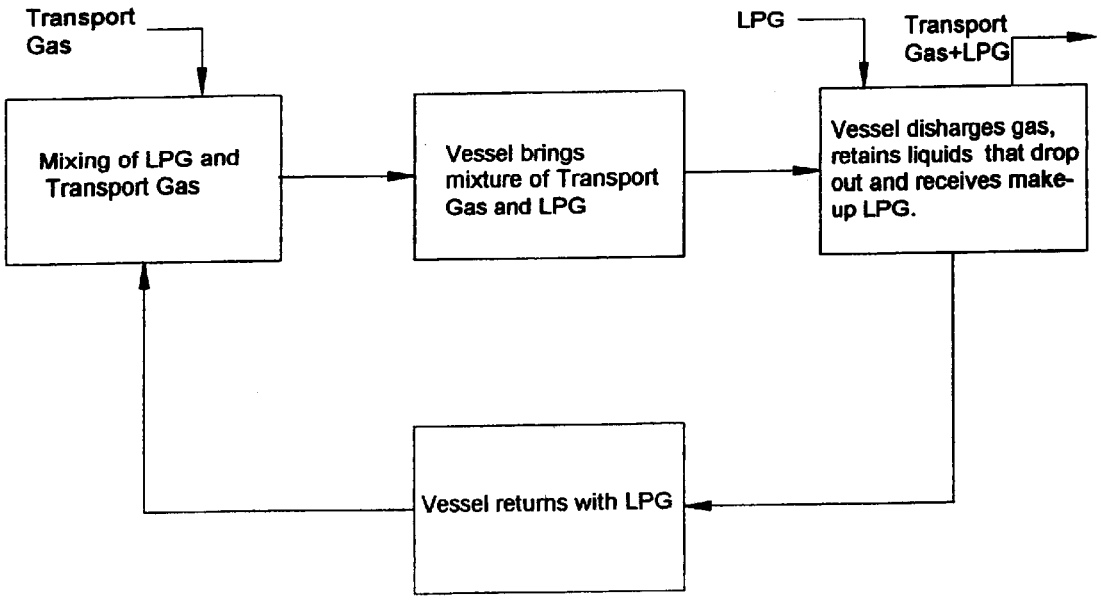
FIG. 7 is a diagram of a shipping cycle in which the mixing gas for conditioning the natural gas is received at the origin.

FIG. 7 shows a second cycle. This is a similar cycle to the cycle shown in FIG. 6 in which the transport gas (natural gas) contains insufficient LPG that an adequate supply of LPG mixing gas drops out during discharge. In this case the transport gas may be made leaner downstream through the recovery of LPG (not shown). This may be done with a number of known technologies by equipment (not shown) that normally will be placed on land at the receiving point but which also may-be mounted on the ship. Depending on the composition of the transport gas nearly all or a fraction of its LPG content may be separated at the destination. Make-up LPG may be obtained downstream as shown on FIG. 7. However, the source of mixing gas replacement may also be upstream (not shown) at the delivery point rather than downstream as shown in FIG. 7.

Figure 8:
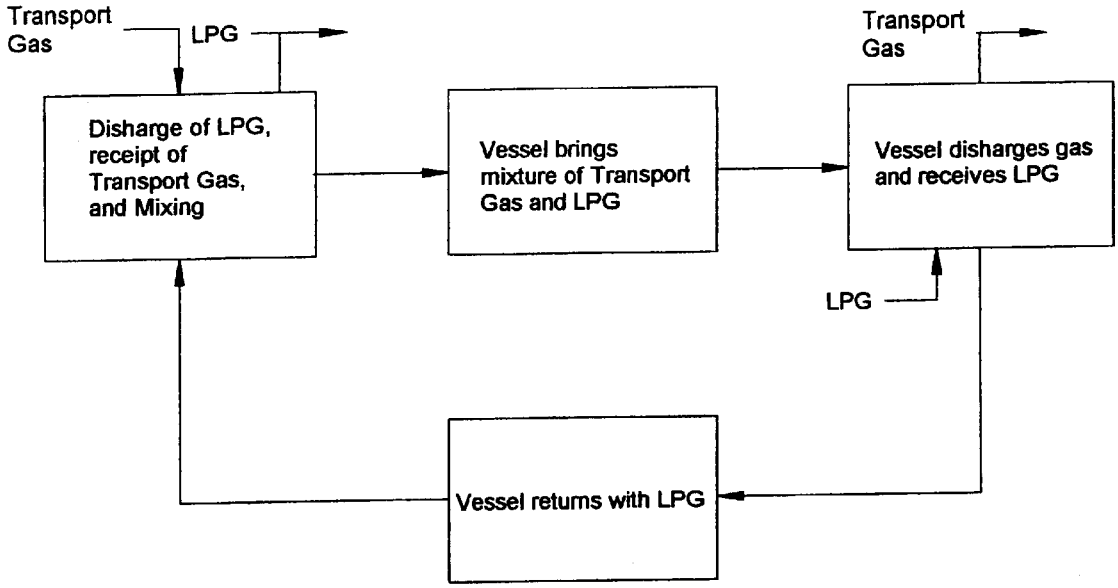
FIG. 8 is a diagram showing a shipping cycle of the simultaneous shipping of natural gas in one direction and of liquid petroleum gas in opposite direction.

FIG. 8 shows a fourth cycle in which natural gas is shipped one way and LPG the opposite way and in which part of the LPG is delivered at the origin of the natural gas and the rest is used as mixing gas.

The concepts that are shown may be combined in numerous ways including partial supply or partial withdrawal of LPG to or from the ship at the delivery point combined with partial supply or partial withdrawal of LPG at the upstream receiving point.

While the description of the invention pertains to the storage and transport of fuel gas aboard ships the concept also applies to other means of transport such as railroad and truck transportation.

In the above description of the invention, those skilled in the art will perceive improvements, changes and modifications. Improvements, changes and modifications within the skill of the art are intended to be covered by the claims.

TABLE 1

| Component | Mixture 1 | Mixture 2 | Mixture 3 | Mixture 4 | Mixture 5 |
|---|---|---|---|---|---|
| Mixture 1 | 100 | 90 | 75 | 50 | 0 |
| Mixture 2 | 0 | 10 | 25 | 50 | 100 |
| Methane | 92.8910 | 83.7709 | 70.0903 | 47.2905 | 1.6900 |
| Ethane | 3.2280 | 3.4966 | 3.8995 | 4.5710 | 5.9140 |
| Propane | 1.1240 | 3.0816 | 6.0180 | 10.9120 | 20.7000 |
| i-Butane | 0.2390 | 1.9821 | 4.5968 | 8.9545 | 17.6700 |
| n-Butane | 0.3200 | 3.1555 | 7.4088 | 14.4975 | 28.6750 |
| i-Pentane | 0.0760 | 1.2076 | 2.9050 | 5.7340 | 11.3920 |
| n-Pentane | 0.0500 | 1.0787 | 2.6218 | 5.1935 | 10.3370 |
| Hexane | 0.0370 | 0.3437 | 0.8038 | 1.5705 | 3.1040 |
| Heptane | 0.0110 | 0.0543 | 0.1193 | 0.2275 | 0.4440 |
| Octane | 0.0040 | 0.0099 | 0.0188 | 0.0335 | 0.0630 |
| Nonane | 0.0010 | 0.0019 | 0.0033 | 0.0055 | 0.0100 |
| Decane | 0.0000 | 0.0001 | 0.0003 | 0.0005 | 0.0010 |

TABLE 1-continued

| Component | Mixture 1 | Mixture 2 | Mixture 3 | Mixture 4 | Mixture 5 |
|---|---|---|---|---|---|
| Nitrogen | 0.5910 | 0.5319 | 0.4433 | 0.2955 | 0.0000 |
| Carbon Dioxide | 1.4280 | 1.2852 | 1.0710 | 0.7140 | 0.0000 |
| Total | 100.000 | 100.000 | 100.000 | 100.000 | 100.000 |
| Molecular Weight | 17.6273 | 21.5645 | 27.4702 | 37.3131 | 56.9989 |

TABLE 2

| Sample Transport Gas | | | |
|---|---|---|---|
| | Mol wt. | Mol % | |
| Methane | 16.04 | 94.50 | |
| Ethane | 30.07 | 1.50 | |
| Propane | 44.09 | 0.87 | |
| Nitrogen | 28.02 | 2.65 | |
| Carbon dioxide | 44.01 | 0.48 | Mol wt. (Mixture) |
| | | 100.00 | 16.95 |

TABLE 3

| Sample Mixing Gas | | | |
|---|---|---|---|
| | Mol wt. | Mol % | |
| Propane | 44.09 | 20.00 | |
| Butane | 58.12 | 55.00 | |
| Pentane | 72.14 | 20.00 | |
| Hexane | 86.17 | 5.00 | Mol wt. (Mixture) |
| | | 100.00 | 59.52 |

What is claimed is:

1. A gas transport system for transport of first hydrocarbon gases including c1 and c2, the system comprising: a vehicle, the vehicle including:

means for receiving and discharging the first hydrocarbon gases; and one or more pressure vessels coupled to the means for receiving and discharging, the pressure vessels being capable of withstanding pressure in a range of 5 to 25 MPa, the pressure vessels each containing a store of second hydrocarbon gases and liquids including c2 through c7;

wherein a mixture of the first hydrocarbon gases with the second hydrocarbon gases in the one or more pressure vessels has a lower compressibility factor than a compressibility factor of the first hydrocarbon gases alone.

2. The gas transport system according to claim 1, wherein said vehicle is one of a ship and a barge.

3. The gas transport system according to claim 1, wherein said vehicle is one of a railroad car and a truck.

4. The gas transport system according to claim 1, wherein the mixture is transported at a temperature is between −25 deg C. and +50 deg C.

5. A method for transporting first hydrocarbon gases including c1 and c2 hydrocarbons in transport vehicles comprising the steps of:

mixing said first hydrocarbon gases with second hydrocarbon gases and liquids in the transport vehicle at a shipping point, the second hydrocarbon gases and liquids including hydrocarbons c2 through c7, in order to achieve a partial density of said first hydrocarbon gases higher than a density of said first hydrocarbon gases alone at a given transport temperature and pressure;

moving the transport vehicle to a delivery point; and discharging the mixture of said first hydrocarbon gases and said second hydrocarbon gases and liquids at the delivery point.

6. The method according to claim 5, further comprising the steps of:

recovering one of some and all of said second hydrocarbon gases and liquids from the mixture of said first hydrocarbon gases and said second hydrocarbon gases and liquids at the delivery point; and loading one of some and all of said recovered gases and liquids aboard said transport vehicle for transport back to the shipping point.

7. The method according to claim 6, wherein the recovery step includes the step of recovering one of some and all of said recovered gases aboard said vehicle for storage aboard said vehicle.

8. The method according to claim 7, further comprising the step of: discharging part of said recovered gases and liquids at the shipping point.

9. A method for transporting first hydrocarbon gases in transport vehicles comprising the steps of:

receiving said first hydrocarbon gases at a shipping point;

mixing a second hydrocarbon substance in the transport vehicle with said first hydrocarbon gases in order to achieve a partial density of said first hydrocarbon gases higher than a density of said first hydrocarbon gases alone at a given transport temperature and pressure, the second hydrocarbon substance including one of second hydrocarbon gases, second hydrocarbon liquids and a mixture of second hydrocarbon gases and second hydrocarbon liquids;

moving the transport vehicle to a delivery point; and discharging said first hydrocarbon gases at the delivery point.

10. The method according to claim 9, wherein the discharging step includes the step of retaining one of some and all of said second hydrocarbon substance in the transport vehicle.

11. The method according to claim 9, further comprising the steps of:

retaining one of some and all of said second hydrocarbon substance in the transport vehicle; and moving the transport vehicle with the retained second hydrocarbon substance to one of the shipping point and an alternative shipping point.

12. A gas transport system for transport of first hydrocarbon gases comprising a vehicle, the vehicle including:

means for receiving and discharging the first hydrocarbon gases;

one or more pressure vessels coupled to the means for receiving and discharging, the pressure vessels being capable of withstanding pressure in a range of 5 to 25 MPa; and a store of second hydrocarbon substances contained in the pressure vessels, the second hydrocarbon substances having a molecular weight greater than a molecular weight of the first hydrocarbon gases, the second hydrocarbon substances including one of second hydrocarbon gases, second hydrocarbon liquids and a combination of second hydrocarbon gases and second hydrocarbon liquids;

wherein a gas and liquid mixture of the first hydrocarbon gases with the second hydrocarbon substances in the one or more pressure vessels has a lower compressibility factor than a compressibility factor of the first hydrocarbon gases alone.

13. The gas transport system according to claim 12, wherein the first hydrocarbon gases include molar quantities of one or more of hydrocarbons c1 and c2.

14. The gas transport system according to claim 12, wherein the second hydrocarbon substances include molar quantities of one or more of hydrocarbons c2 through c7.

15. The gas transport system according to claim 12, wherein the second hydrocarbon substances include the combination of second hydrocarbon gases and second hydrocarbon liquids.

* * * * *